United States Patent [19]

Mourou et al.

[11] 4,413,178

[45] Nov. 1, 1983

[54] SWEEP DRIVE CIRCUIT FOR A STREAK CAMERA

[75] Inventors: Gerard A. Mourou; Wayne H. Knox, both of Rochester, N.Y.

[73] Assignee: University of Rochester, Rochester, N.Y.

[21] Appl. No.: 246,830

[22] Filed: Mar. 23, 1981

[51] Int. Cl.[3] ..... H01J 31/50

[52] U.S. Cl. ..... 250/213 VT; 313/537

[58] Field of Search ..... 250/211 J, 213 VT; 313/94, 421, 99; 315/409, 410, 408, 360

[56] References Cited

U.S. PATENT DOCUMENTS 4,282,427 8/1981 Brjukhnevich et al. ..... 250/213 VT 4,327,285 4/1982 Bradley ..... 250/213 VT

*Primary Examiner*—David C. Nelms

*Attorney, Agent, or Firm*—Martin Lukacher

[57] ABSTRACT

An inexpensive, simple and highly accurate sweep drive circuit for streak cameras generates a ramp voltage for the deflection plates of an image converter tube of a streak camera. A solid state switch is used in a manner which eliminates the need for a pulsed multi-kilovolt bias voltage and the use of cryogenics. High voltage direct current in the multi-kilovolt range is applied to a charged circuit which may include a high voltage capacitor or use the capacitance presented by the deflection plates of the tube. The switch is laser activated and becomes photo-conducting. The charge in the capacitor passes through a charging resistor which controls the sweep rate to the deflection plates. After the activating laser pulse, the switch returns rapidly to a nonconducting state, during the recombination time of the switch material. The photo-electron beam is swept linearly over a substantial portion of the recombination time from off the image forming phosphor screen to off screen on the other side thereof. A resistor connected to the deflection plates provides a time constant long compared to the transient event lifetime, which may be the fluorescence decay time of the system under study, and the beam remains off the phosphor screen for a very large time compared to the fluorescence decay time. In a second configuration when the deflection plates are used as the charged source, the laser-activated switch is connected between a deflection plate and a point of reference potential (ground) through the charging resistor.

24 Claims, 5 Drawing Figures

SWEEP DRIVE CIRCUIT FOR A STREAK CAMERA

The present invention relates to sweep drive circuits for streak cameras, and particularly to streak camera sweep drive circuits using solid state switches which are actuated by radiation, such as laser light, to become photo-conductive.

This application is related to the following applications filed in the name of Gerard A. Mourou, one of the inventors hereof, which relate to solid state light activated switches which are useful in streak camera sweep drive circuits: U.S. Pat. No. 4,218,618 issued Aug. 19, 1980; U.S. patent application Ser. No. 96,711 filed Nov. 21, 1979, now U.S. Pat. No. 4,301,362 issued Nov. 17, 1981 and U.S. patent application Ser. No. 160,691 filed June 18, 1980 now U.S. Pat. No. 4,329,686 issued May 11, 1982.

The streak camera is an extremely useful tool for measuring optical transient events on a picosecond ($10^{-12}$ second) time scale. Streak cameras are described in the following articles: D. J. Bradley and G. H. C. New, Proc. IEEE 62, 313 (1974) and D. J. Bradley, Opt. Laser Tech., Feb. 1979. Sweep circuits using light activated solid state switches are described in the following articles: G. Mourou and W. Knox, Appl. Phys. Lett. 36 (8), 623 (April 1980) and M. Stavola, G. Mourou and W. Knox, Opt. Comm. 34 (3), 404 (September, 1980). The sweep drive circuits shown in the earlier article require high voltage bias pulses which are switched by the solid state switch. The later article permits the sweep circuit to be operated with constant high voltage DC which is switched by the solid state switch; however, the switch is maintained at cryogenic temperature.

It is a principal object of the present invention to provide an improved sweep drive circuit for streak cameras which is simple, inexpensive and highly accurate and which may be operated with constant high voltage DC and at room temperature.

It is a further object of the invention to provide improved streak camera sweep drive circuits having sub-picosecond timing accuracy of the sweep and which enables the accommodation of picosecond optical transients and the measurement of transient events on a time scale calibrated in picoseconds.

It is a still further object of the present invention to provide improved streak camera sweep drive circuits which provide sweeps with timing jitter of less than 5% of the optical pulse width from sweep to sweep.

It is a still further object of the present invention to provide improved streak camera sweep drive circuits which produce ramp voltages on the deflection plates of the streak camera image converter tube in which voltage fluctuations are minimized, such that the sweep speed can be controlled to within a variation of ±0.1% during from sweep to sweep.

It is a still further object of the present invention to provide improved sweep drive circuits for streak cameras in which retrace of the photo-electron beam during the transient event does not occur and the beam remains off the screen after the sweep for a large time (e.g., one millisecond) compared to the transient lifetime under study.

It is a still further object of the present invention to provide improved sweep circuits for streak cameras which increase the usefulness of the streak camera, as a means to average weak picosecond optical transients, and by extending the range of accuracy and resolution thereof.

It is a still further object of the present invention to provide improved sweep drive circuits for streak cameras which avoid the need for wide band geometry and construction in order to obtain high sweep speeds.

Briefly described, a streak camera sweep drive circuit embodying the invention may be mounted on and used with a streak camera having an image converter tube which has deflection plates for causing a photo-electron beam to sweep across the phosphor screen of the tube. A radiation activated solid state switch, preferably including a body of semi-insulating, semiconductor material is used, which is activated by laser light into a photo-conductive condition and has a short recombination time after the activating light is removed. The circuit has means for providing at the beginning of each sweep a charged circuit, charged to a high voltage in the kilovolt range with respect to a reference potential, such as ground potential. This charged circuit, in one case, includes the capacitance presented by the deflection plates and in another case a high voltage capacitor. A resistor connected to the deflection plates provides a time constant long compared to the lifetime of the transient event and the fluorescent decay time of the system under study. In the case where the charged circuit includes the high voltage capacitor, the solid state switch is connected between the high voltage capacitor and one of the deflection plates. In the case where the capacitance presented by the deflection plates themselves provide the charged circuit, the switch is connected between one of the deflection plates and a point at reference potential. The other deflection plate is also connected to the point at reference potential. Means, which may include fiber optics, couples radiation to the body of semiconductor material of the switch and activates the switch to initiate the sweep. The ramp voltage generated by the circuit and appearing across the deflection plates is linear over a sweep time equal to the majority of the recombination time of the semiconductor material of the switch. The sweep is precisely timed with sub-picosecond accuracy to the pulse of activating radiation and is substantially free of timing jitter and voltage fluctuations.

The foregoing and other objects, features and advantages of the invention as well as presently preferred embodiments thereof will become more apparent from reading of the following descriptions in connection with the accompanying drawings in which.

Figure 1:
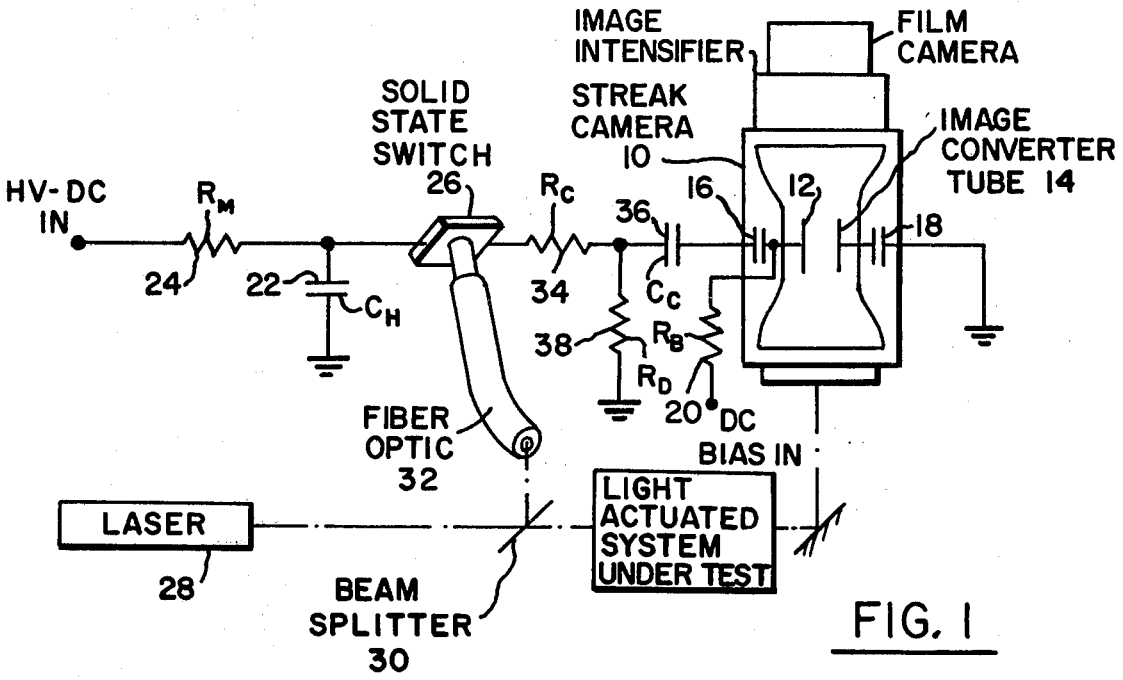
FIG. 1 is a schematic diagram of a streak camera equipped with a sweep drive circuit in accordance with an embodiment of the invention.

Referring to FIG. 1, there is shown a streak camera 10 of conventional design. The image converter tube of the camera has electron optics including deflection plates 12 and 14. A photo-electron beam is generated at a photocathode at one end of the tube. This beam is swept across a phosphor screen at the opposite end of the tube. The image on the screen may be applied to an image intensifier and recorded on film in a film camera. Other optical analyzing means may be used in conjunction with the image intensifier, such as an optical multichannel analyzer. The converter tube may include capacitors 16 and 18 connected to the deflection plates thereof. One of these capacitors 18 connects one of the plates 14 to a point of reference potential such as ground. A DC bias is applied via a bias resistor, $R_B$,20 to the other deflection plate 12 this voltage is of such a polarity as to maintain the beam off the screen, except during the sweep.

To generate a ramp voltage and provide sweep drive to the deflection plates 12 and 14, a multikilovolt high voltage direct current (DC) input is used, as may be obtained from a high voltage well regulated power supply. This is a multikilovolt voltage, suitable five kilovolts in amplitude. A charging capacitor $C_H$, 22 is charged to the high voltage from the input through a current limiting resistor $R_M$, 24. The $C_H$ charging capacitor 22 is preferably a low inductance, high voltage capacitor. The $R_M$ current limiting resistor 24 suitably has a high value of resistance, for example one megohm. The capacitor 22 of the charging circuit is discharged by a solid state switch 26. This switch is suitably made of a body of semi-insulating, semiconductor material of high resistence in the absence of activating radiation. It has high resistivity and hence large DC holdoff without thermal instability. In a preferred form the semi-insulating semiconductor material is gallium arsenide (GaAs) doped with chromium (Cr) and of rectangular configuration with a gap of a few millimeters (e.g., 3 millimeters) between electrodes at the opposite ends thereof. Other semiconductor, semi-insulating materials may be used. The materials should be photo-conductive when actuated by radiation and have a relatively short recombination time. GaAs doped with chromium is preferred. Intrinsic silicon made semi-insulating by neutron bombardment may also be used. Other semiconductors made semi-insulating by doping with a deep lying impurity may also be used. A rectangular body of GaAs doped with chromium which is approximately 3 millimeters long, 1 millimeter wide and ½ millimeter thick, with a 2 millimeter gap has been found suitable. Polycrystalline GaAs may be used when longer recombination times than obtained with single crystal GaAs are desired.

When excited by a laser pulse of from 50 to 100 microjoules at a wavelength of 1.06 micrometers, the switch becomes photo-conducting with a rise time limited by the width of the light pulse from the activating laser 28. The switch returns to a nonconducting state after about 1.3 to 1.5 nanoseconds which is the recombination time of the switch material.

Light from the laser 28 which activates the switch is coupled thereto via a beam splitter 30 and fiber optic means 32. A bundle of optical fibers, the end of which is put into contact with one side of the body of semiconductor material, applies the activating light pulse from the laser to the switch 26. The light actuated system under test, for example a laser in a fusion system, provides an optical output which is a transient event, synchronized with the laser activating pulse. The sweep is initiated by the light pulse when the switch 26 is made conductive. The transient event is also synchronized with the light pulse from the laser 28. Accordingly, the transient event and the sweep occur simultaneously and are displayed by the streak camera.

Figure 2:
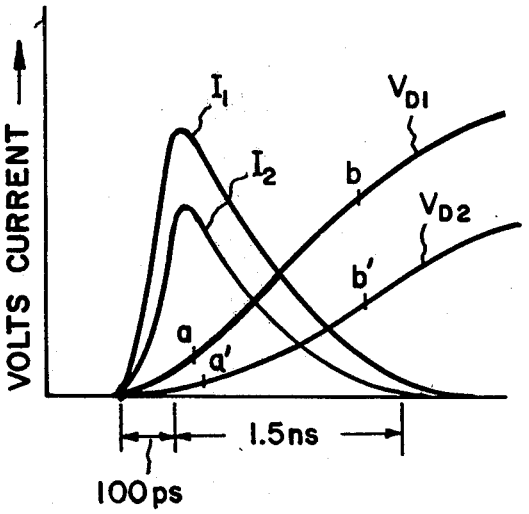
FIG. 2 are curves illustrating the current passing between and the voltage across the deflection plates of the streak camera image converter tube during the sweep time which is obtained with the circuit shown in FIG. 1.

The sweep is produced by discharge current from the $C_H$ capacitor 22. This current passes through a charging resistor 34, which is indicated as the $R_C$ resistor and a coupling capacitor 36 (the $C_C$ capacitor) to the deflection plate 12. The current also passes through the coupling capacitor 16. Due to the inherent capacitance presented by the deflection plates, the current passes between the plates and to ground through the remaining tube capacitor 18. The rise time of the current occurs during the activating light pulse. This rise time is indicated in FIG. 2 as being approximately 100 picoseconds. The current continues to flow during the recombination time of approximately 1.5 nanoseconds. During this period of time, the voltage across the deflection plates 12 and 14 increases. For the majority of the recombination time this increase is linear. The linear sweep occurs during the interval from a to b and a' to b' in the voltage curves shown in FIG. 2. Two voltage curves $V_{D1}$ and $V_{D2}$ are illustrated for two different currents $I_1$ and $I_2$. These different currents and different sweep rates as indicated by the slope of the voltage curves $V_{D1}$ and $V_{D2}$, are obtained by changing the value of the charging resistor 34. This resistor may for example be one hundred ohms to obtain the higher current curve $I_1$ and two hundred ohms to obtain the lower current curve $I_2$.

Once the photo-electron beam is deflected across the screen, it is desirable that it stay off the screen for a large time compared to transient event lifetime which may be the fluorescence decay time of the system (e.g., the samples) under study. If the retrace of the beam occurred during the transient event being imaged by the streak camera, the measurement could not be made. In order to assure that the beam remains off the screen after the sweep, the discharge resistor, 38 ($R_D$) is provided. This discharge resistor has a high value of resistance, for example 5 to 6 megohms, and with the coupling capacitor $C_C$, the other capacitors 16 and 18 and the capacitance presented by the deflection plates 12 and 14 provides a very long time constant. Accordingly, the voltage across the deflection plates 12 and 14 remains high and the beam remains off screen until well after the sweep measurement interval, such as a to b or from a' to b', as illustrated in FIG. 2, has expired. The $R_B$ bias resistor 20 is also in the discharge circuit of the deflection plates 12 and 14. This resistor also has a very high value and does not interfere with the slow discharge and maintenance of the off screen deflecting voltage at the end of the sweep.

Figure 3:
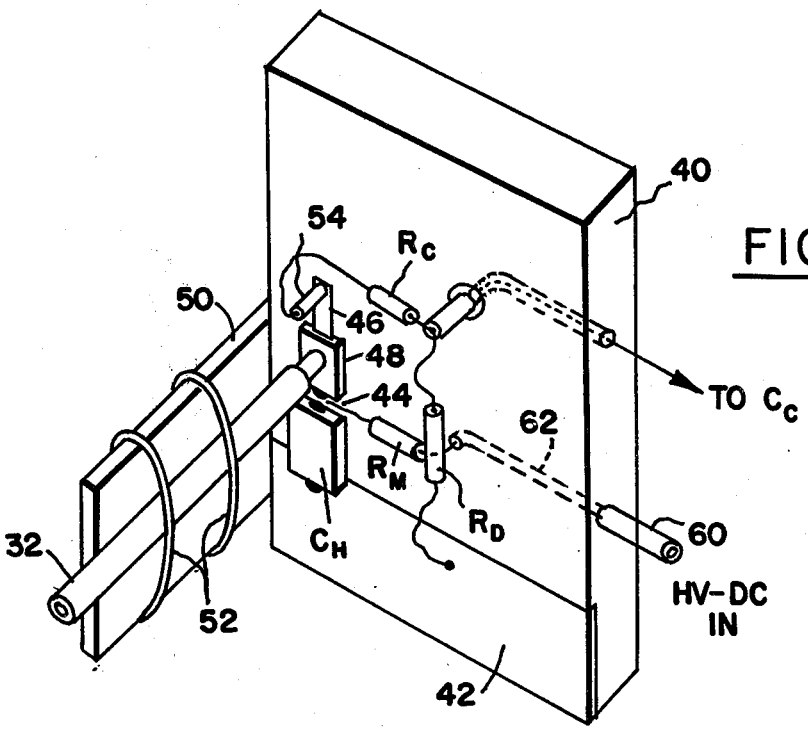
FIG. 3 is a perspective view of the streak camera sweep drive circuit shown in FIG. 1, the circuit being mounted on a circuit board.

The sweep drive circuit may be implemented in a simple and inexpensive manner, without the use of wide band-width geometry or construction. Referring to FIG. 3, a circuit board 40 is used to mount the circuit. This board may be a conventional epoxy-glass impregnated board, clad with conductive material such as copper in a layer on one side thereof. This layer is removed except for a strip 42 along one edge and areas 44 and 46 which are spaced from each other. The area 44 is spaced from the area 42 on which the conductive cladding remains. The body 48 of semiconductor material, providing the solid state switch 26, is disposed on the board 40 in juxtaposition with the surface thereof between the areas 44 and 46. The ends of the body 48 are attached, as by soldering them to the areas 44 and 46.

Another board 50 is attached to the edge of the board 40 and the fiber optic bundle 32 is secured thereto by bindings 52. The end of the fiber optic bundle is brought down in juxtaposition with the exposed side of the body 48 of semiconductive material.

The low inductance, charging capacitor $C_H$ is disposed between the conductive areas 42 and 44 and attached at the end thereof to these areas, as by solering. A standoff terminal 54 is in conductive contact with the upper area 46. Another standoff terminal 56 is mounted on the board and a lead therefrom is taken through a hole 58 in the board. This lead is connected to the coupling capacitor $C_C$ which may be a high voltage capacitor mounted directly to the image converter tube. Clips (not shown) at the ends of the standoff terminals 54 and 56 receive the leads of the charging resistor $R_C$ and enable this resistor to be changed easily to vary the sweep rate.

The current limiting resistor $R_M$ is connected to the area 44. A high voltage connector 60 is mounted on the edge of the board 40 and a lead of the $R_M$ resistor is extended thereto through a hole 62 in the board 40. The $R_B$ resistor is soldered at one end to the area 42 and at the other end thereof to the standoff terminal 56. In order to hold the fiber optic and the switch components in position, the end of the fiber optic, the body 48 of semiconductor material and the region of the board 40 surrounding them may be potted, preferably in clear epoxy. The circuit and its mounting may be inserted into the shell of the image converter tube when in use.

Figure 5:
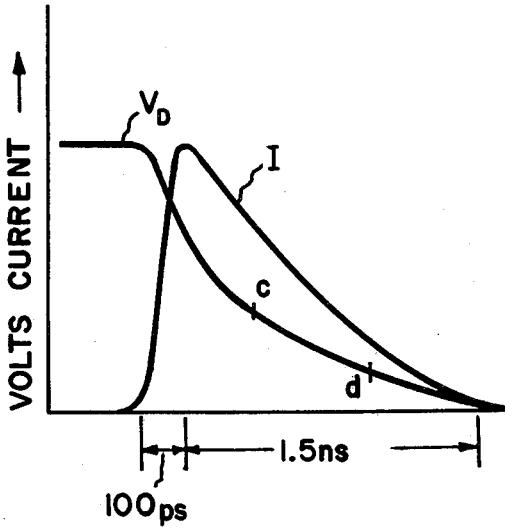
FIG. 5 are curves illustrating the voltage across and current passing between the deflection plates of the streak camera shown in FIG. 4 during the sweep time.
Figure 4:
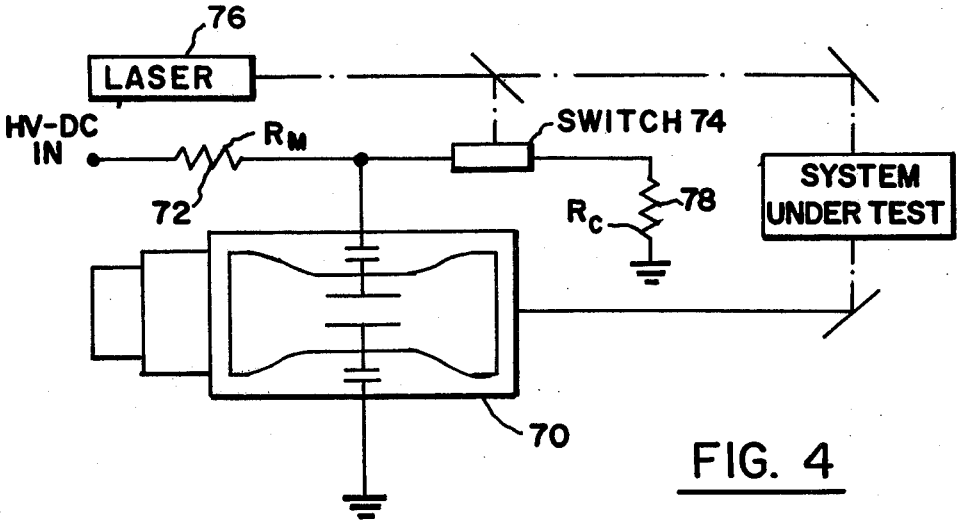
FIG. 4 is a schematic diagram of a streak camera having a sweep drive circuit in accordance with another embodiment of the invention.

Referring next to FIG. 4 there is shown a streak camera 70 which may be the same as the camera 10 shown in FIG. 1. The sweep drive circuit also uses high voltage direct current in the multi-kilovolt range, suitably 5 kilovolts, to develop the sweep voltage for the deflection plates of the camera image converter tube. The plates themselves present a capacitance which is charged through a current limiting resistor 72, which is also labeled $R_M$. This may be a large resistor having a value of 1 megohm. The deflection plates are thus normally charged to the high deflection voltage which is indicated at the upperpart of the $V_D$ curve in FIG. 5. The voltage is switched by a solid state switch 74. A laser 76 provides a suitable form of radiation and activates the switch 74 by illuminating it with a pulse of light. When the switch is conductive during the activating pulse and during the recombination time of the switch material, the capacitance of the deflection plates as well as the other capacitors in the tube of the streak camera 70 discharge through the switch 74 and the $R_C$ resistor 78. The voltage across the deflection plate decreases substantially linearly during the discharge time. As shown in FIG. 5, the discharge time may include 100 picoseconds which contains the interval of the light pulse from the laser and a 1.5 nanosecond interval which contains the recombination time of the switch material. During a substantial portion of this interval, indicated from c to d in FIG. 5, the sweep is linear. The system under test is activated also by the pulse from the laser. Accordingly the optical transient event which is detected and converted into a photo-electron beam by the streak camera tube occurs during the sweep and may be recorded by means of the streak camera 70. In order to change the speed of the sweep (sweep rate), the value of resistance of the $R_C$ resistor 78 may be changed. Only one current and deflection voltage is illustrated in FIG. 5 for the sake of simplicity.

At the end of the sweep, the switch 78 is nonconductive. The only path for recharging current which could retrace the beam is through the large value, $R_M$ current limiting resistor 72. Accordingly the beam stays off the screen for a long time compared to the lifetime of the transient event.

From the foregoing description it will be apparent that there have been provided improved streak camera sweep drive circuits. Variations and modifications of the herein described circuits, within the scope of the invention, will undoubtedly suggest themselves to those skilled in the art. Accordingly the foregoing description should be taken as illustrative and not in a limiting sense.

We claim:

1. A streak camera sweep drive circuit for use with a streak camera for studying transient events having an image converter tube which has deflection plates, said circuit comprising a radiation activated solid state switch, means for providing at the beginning of said sweep a charged circuit to a high voltage in kilovolt range which respect to a reference potential, said circuit including the capacitance presented by said deflection plates, a resistor connected to said deflection plates for providing a time constant long compared to the life time of the transient event, said switch being connected between one of said deflection plates and a point at said reference potential, and means for applying radiation to said switch for activating the same to initiate the sweep.

2. The invention as set forth in claim 1 wherein said solid state switch comprises a body of semi-insulating, semiconductor material, a circuit board having spaced areas of conductive material on one side thereof, said body being disposed between said spaced areas and connected thereto at opposite ends of said body.

3. The invention as set forth in claim 2 wherein said body is rectangular in shape and having opposite sides, one of said sides being in juxtaposition with said board in the space between said spaced areas.

4. The invention as set forth in claim 3 wherein said radiation applying means comprises fiber optic means having an end disposed in juxtaposition with the other of said opposite sides of other said body.

5. The invention as set forth in claim 1 wherein said solid state switch includes a body of semi-insulating, semiconductor material.

6. The invention as set forth in claim 5 wherein said material is GaAs doped with Cr.

7. The invention as set forth in claim 5 wherein said semiconductor material is neutron irradiated intrinsic silicon.

8. The invention as set forth in claim 1 further comprising a current limiting resistor for applying said high voltage through said one plate, a charging resistor of resistance value much lower than that of said current limiting resistor, said switch being connected between said one deflection plate and said charging resistor, said charging resistor also being connected to said reference potential point.

9. The invention as set forth in claim 8 wherein said switch contains a body of high resistivity, semi-insulating semiconductor material having a fast recovery time from photo-conductive to nonconductive condition after said activating radiation is removed therefrom.

10. The invention as set forth in claim 9 further comprising means for changing the resistance value of said charging resistor to change the speed of said sweep.

11. A streak camera sweep drive circuit for use with a streak camera for studying transient events having an image converter tube which has deflection plates, said circuit comprising a radiation activated solid state switch, means for providing at the beginning of said sweep a charged circuit charged to a high voltage in the kilovolt range with respect to a reference potential, said circuit including a high voltage capacitor, a resistor connected to said deflection plates for providing a time constant long compared to the life time of the transient event, said switch being connected between said high voltage capacitor and one of said deflection plates, and means for applying radiation to said switch for activating the same to initiate the sweep.

12. The invention as set forth in claim 11 wherein said solid state switch comprises a body of semi-insulating, semiconductor material, a circuit board having spaced areas above conductive material on one side thereof, said body being disposed between said spaced areas and connected thereto at opposite ends of said body.

13. The invention as set forth in claim 12 wherein said body is rectangular in shape and having opposite sides, one of said sides in juxtaposition with said board in the space between said spaced areas.

14. The invention as set forth in claim 13 wherein said radiation applying means comprises fiber optic means having an end disposed in juxtaposition with the other of said opposite sides of said body.

15. The invention as set forth in claim 11 wherein said solid state switch includes a body of semiinsulating, semiconductor material.

16. The invention as set forth in claim 15 wherein said material is GaAs doped with Cr.

17. The invention as set forth in claim 16 wherein said semiconductor material is neutron radiated intrinsic silicon.

18. The invention as set forth in claim 11 further comprising a current limiting resistor, means for applying said kilovolt range voltage to said high voltage capacitor through said resistor, a charging resistor, said high voltage capacitor being connected through said switch and said charging resistor to said one deflection plate.

19. The invention as set forth in claim 18 further comprising means for changing the value of resistance of said charging resistor to change the speed of the sweep.

20. The invention as set forth in claim 18 wherein said resistor for providing said long time constant comprises a resistor connected from said reference potential point to the connection between said one deflection plate and said charging resistor.

21. The invention as set forth in claim 20 further comprising a coupling capacitor connected between the junction of said charging and long time constant providing resistors and said one deflection plate.

22. The invention as set forth in claim 21 further comprising a source of DC bias connected to said one deflection plate via a bias resistor which is of resistance value much higher than the charging resistor and which also provides for the long time constant.

23. The invention as set forth in claim 20 further comprising a printed circuit board having a plurality of areas of conductive material on one side thereof, a first of said areas being disposed along one edge of said board and providing said reference potential point, a pair of said areas being spaced from each other, one of said pair being spaced from said first area, said switch including a body of semi-insulating, semiconductor material having a fast recovery time from photo-conductive to nonconductive condition deflectors said activating radiation is removed, said body being disposed in juxtaposition with said board between said pair of areas and connected thereto at opposite ends thereof, said high voltage capacitor being disposed between said first area and said one of said pair of areas as being connected thereto at opposite ends thereof, and said current limiting, charging and long time constant providing resistors being mounted on said board.

24. The invention as set forth in claim 23 further comprising fiber optic means mounted on said board and having an end juxtaposed with said body for applying said activating radiation thereto.

* * * * *